United States Patent [19]

Rancourt

[11] Patent Number: 4,979,715

[45] Date of Patent: Dec. 25, 1990

[54] HANGER FOR SUSPENDED CEILING

[76] Inventor: Pierre J. Rancourt, 29, Arcand, St-Athanase, Québec, Canada, J2X 4J3

[21] Appl. No.: 435,188

[22] Filed: Nov. 13, 1989

[51] Int. Cl.[5] ..... A47F 5/00

[52] U.S. Cl. ..... 248/317; 52/484; 248/302

[58] Field of Search ..... 248/317, 343, 302, 303; 52/484, 486

[56] References Cited

U.S. PATENT DOCUMENTS

| | | | |
|---|---|---|---|
| 3,601,862 | 8/1971 | Hargadon | 248/317 X |
| 3,748,804 | 7/1973 | De George | 52/484 |
| 3,859,770 | 1/1975 | Chambers et al. | 52/486 X |
| 3,995,823 | 12/1976 | Hensel | 52/484 X |
| 4,060,025 | 11/1977 | Pelosi, Jr. | 52/484 X |
| 4,084,364 | 4/1978 | Jones | 52/484 |

FOREIGN PATENT DOCUMENTS

| | | | |
|---|---|---|---|
| 1535595 | 8/1968 | France | 52/484 |

*Primary Examiner*—Ramon O. Ramirez

*Attorney, Agent, or Firm*—Roland L. Morneau

[57] ABSTRACT

A hanger for holding a suspended ceiling made of a continuous wire. The wire is shaped at one end, to form two superposed loops adapted to surround a screw which is intended to be threaded in a supporting ceiling. The wire is bent near the loops at about 90 degrees relative to the plane of the superposed loops. The short end of the wire is either twisted to the body of the wire or located inside the apex of the angle formed by the loops and the body of the wire so that it will be tightened when the screw is threaded in the supporting ceiling and the body of the wire is under tension.

4 Claims, 2 Drawing Sheets

HANGER FOR SUSPENDED CEILING

BACKGROUND OF THE INVENTION

Field of the Invention

The present invention is directed to a hanger having one end adapted to surround and be retained by a screw or a nail below a horizontal support and the other end adapted to be bent for hooking onto an element of a suspended ceiling.

Prior Art

Canadian Pat. No. 707,473 describes a device for suspending ceiling tiles wherein one embodiment is a wire having a loop at both ends of two parallel upright sections of the wire which forms a bent V-shape.

In Canadian Pat. No. 761,147, Krysinski makes use of a wire to support a suspended ceiling. His wire has a loop at both ends and both loops are in the same plane as the part of the wire in between.

U.S. Pat. No. 3,748,804 discloses a wire for suspended ceilings having its lower end looped through a hole and suitably tied. The fastening arrangement for holding the upper end of the wire is not specifically identified.

In U.S. Pat. No. 4,084,364, the ceiling is suspended partly by a wire and partly by a compression strut. The method of fastening the wire at its upper end is broadly identified by a clip.

It is also common practice to supply the workers doing the installation of suspended ceilings, with thin, flexible wires and to let them tie it with knots or the like.

SUMMARY OF THE INVENTION

The hanger, according to the invention, is characterized by a steel wire having a uniform cross-section and forming two superposed loops for encircling and for being retained by a screw to be fixed under a horizontal support. The two superposed loops are in a plane substantially perpendicular to the remaining main body of the wire. The remaining main body of the wire is either hooked or twisted with the other end of the wire.

DETAILED DESCRIPTION OF THE INVENTION

Suspended ceilings are generally retained by a horizontal cement surface at a distance thereof to allow installation of ducks, light fixtures and the like. The suspended ceilings are generally held to the cement surface by strong, relatively rigid strips or wires. These wires are sufficiently strong to support the weight of the suspended ceiling but are also sufficiently stiff to hinder lateral movement of the suspended ceilings although such lateral movement is not mainly expected from such wires.

Figure 1:
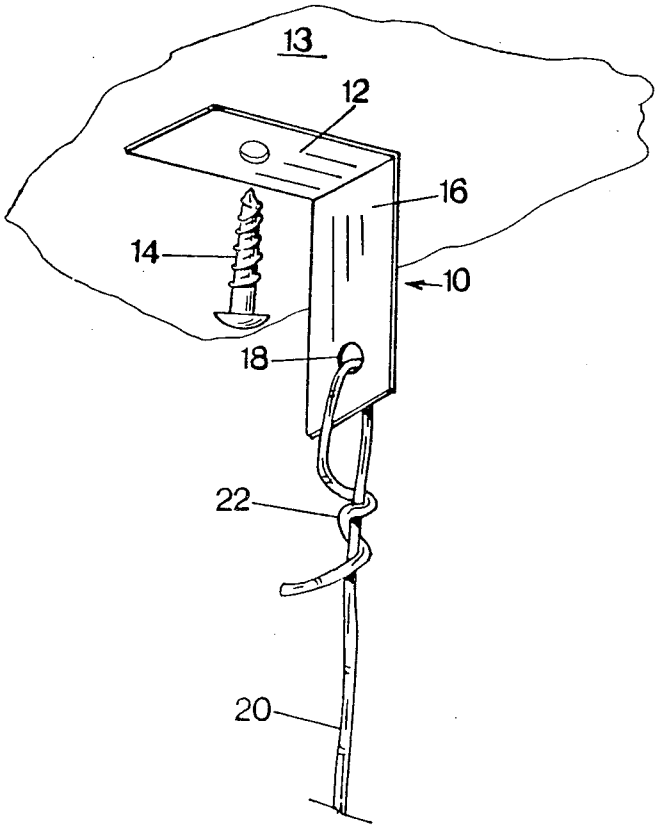
FIG.1 (PRIOR ART)
FIG. 1 is a perspective view of a commonly used hanger for suspending a ceiling according to the prior art.

It is a commonly used custom to retain the upper part of the wire with a bracket 10 such as illustrated in FIG. 1. The bracket 10 is usually a simple square bracket having one face 12 provided with an aperture through which a screw 14 is threaded through a cement surface 13. The downwardly pending face 16 of the bracket 10 is also provided with an aperture 18 through which the wire 20 loosely is twisted. Such an installation is elaborate, time consuming and relatively costy. Considering that the wire 20 is relatively stiff, the twisted part 22 of the wire is frequently loose because it is difficult to manipulate with pliers or the like. Upon a downward tension on the wire 20, the latter will usually have a tendency to slidely move downward and consequently, the suspended ceiling, held at the lower end of the wire, will not be maintained at a constant height.

Figure 3:
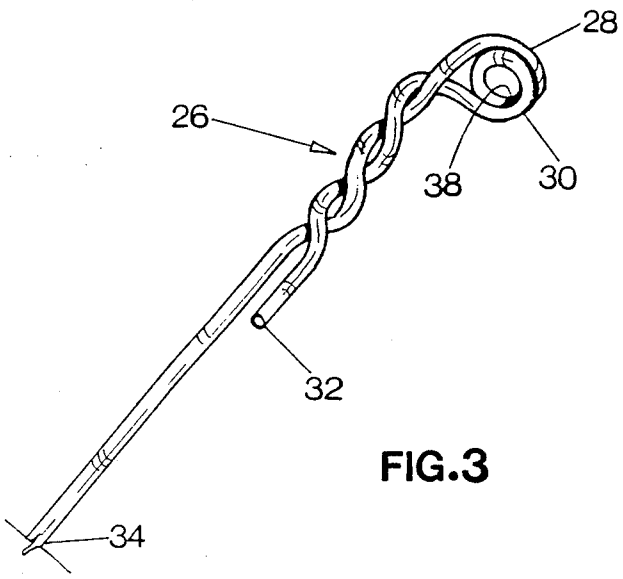
FIG. 3 is a perspective view of the hanger as shown in FIG. 2.
Figure 2:
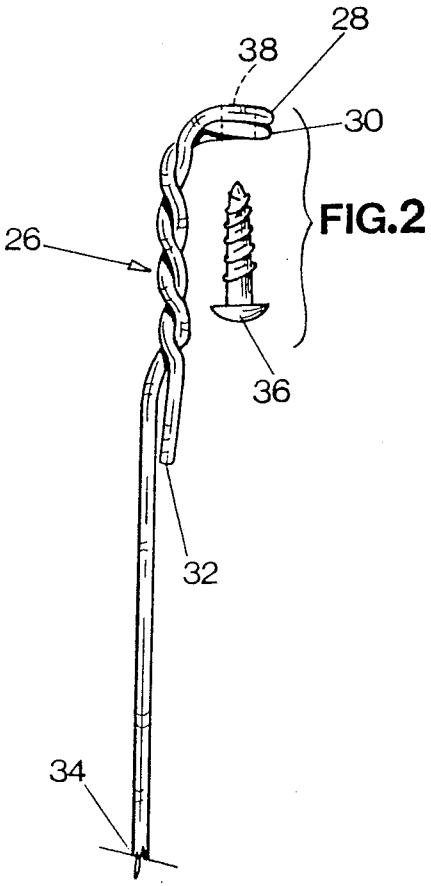
FIG. 2 is a side view of a hanger according to the invention.

A hanger according to the invention, shown in FIGS. 2 and 3, is made of a wire 26 having a pair of loops 28 and 30 of a substantially circular configuration. The two loops 28 and 30 are located in a continuous wire 26 at a position intermediate both ends 32 and 34. The portion of the wire adjacent the shorter end 32 is twisted around the corresponding portion of the wire leading to the other end 34.

The two loops 28 and 30 are disposed in superposed, contiguous parallel planes which are substantially at 90 degrees with the remaining portion of the wire leading to the ends 32 and 34. The angle between planes of the loops and the remaining part of the wire may be slightly greater than 90 degrees to help the worker when the latter threads the screw 36 through the opening 38 of the loops 28 and 30. Although such an angle may be slightly greater than 90 degrees when the hanger is manufactured, the portion of the wire leading to the end 34 can be easily straightened in a vertical direction after the screw 36 has been tightened into the cement surface 13 and will do so automatically when the ceiling is suspended.

The installation of the suspended ceilings according to the present invention is greatly simplified compared to the prior arrangements and in particular to the one described in FIG. 1. The construction regulations for suspended ceilings requires that the wire must be strong and stiff but a worker should be able to bend such wires, as presently illustrated in FIG. 1, and in particular to bend through the hole 18 and to twist it as identified by reference numeral 22. A tightly twisted arrangement can not be expected from a worker on the construction site due to the strength and the rigidity of the wires used. The loops 28 and 30 are preformed with machines according to the desired circumference and both ends of the wire adjacent the loops are twisted and bent to allow the wire to maintain its shape around the screw 36 when the latter is threaded in the cement surface 13. The traction on the end 34 of the wire, which is sufficiently rigid to maintain its shape, tends to tighten the loops 28 and 30 around the screw 36.

Figure 5:
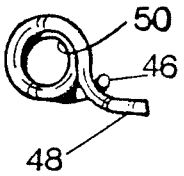
FIG. 5 is a bottom view of the embodiment shown in FIG. 4.
Figure 4:
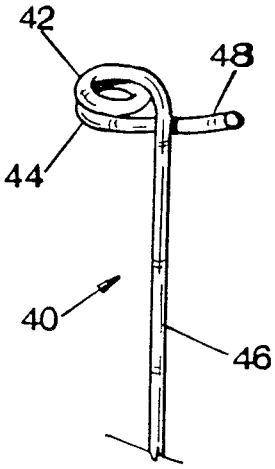
FIG. 4 is a side view of another embodiment of the invention.

FIGS. 4 and 5 show an alternative embodiment of the hanger according to the invention. The hanger 40 comprises two loops 42 and 44 made from a continuous wire, one end 46 of which extends substantially perpendicular to the plane of the loops 42 and 44. However, the other end 48 instead of twisting around the end 46, extends in the same plane as the lower loop 44 and passes inside the apex of the angle formed by the wire between the loops and 44 and the end 46 of the wire. When the screw is introduced inside the aperture 50 in the loops 42 and 44 and is threaded in the supporting ceiling, the weight pulling on the end 46 of the wire has a tendency to squeeze the portion of the end 48 located about the above-mentioned apex and prevents any unexpected loosening of the hanger around the holding screw threaded the supporting cement ceiling.

Although the arrangement of the hanger shown in FIGS. 4 and 5 may appear to have less resistance to an unwinding effect caused by a downward traction on the end 46, compared to the traction on the end 34 in FIGS. 2 and 3, the difference is negligible considering that the wire used for the hanger is relatively rigid and stiff and the rigidity and the stiffness of the wire would prevent unwinding even for the embodiment shown in FIGS. 4 and 5. Considering that suspended ceilings are not considerably heavy and that hangers such as described in FIGS. 2–5 and also in the prior art as shown in FIG. 1 are located at distances of about 3 to 4 feet from each other, each hanger is not under heavy traction. However, for security reasons or otherwise, strong and stiff wires are required and such wires which cannot be bent on the premises or on the site of construction according to the present invention. The wires which are usually employed are made of galvanized soft steel having a diameter of about 0.01 inch with a tolerance of about 20%. Such wires have a resistance to traction between 50 to 100 KIPS/P.S.I.

The lower ends 34 or 46 of the hangers have a length adapted to the distance between the suspended ceiling and the cement supporting ceiling. Suspended ceilings are usually provided with anchor points or holes provided to receive the lower end 34 or 46 of the hangers. The latter ends are being bent according to the desired length and loosely twisted over the vertical part of the wire.

The present invention allows for a quick and easy installation of suspended ceilings compared to laborious and elaborate arrangements used previously. The hanger according to this invention is machine-shop made and, conforms to conventional forms of manufacturing. It is of simple construction and easy to use. It is also economically feasible, long lasting and relatively trouble free in operation.

I claim:

1. A hanger for holding a suspended ceiling comprising a continuous wire having two end portions and a uniform cross-section, said wire forming two superposed loops for surrounding a screw adapted to be fixed under a horizontal support, said loops having substantially the shape of a circle in a portion of the wire intermediate both of said end portions thereof, said both of said end portions of the wire extending from said loops being twisted at least twice over each other, one of said loops being twisted at least twice over each other, one of said end portions of said wire being longer than the other of said end portions adapted to be bent for holding a suspended ceiling, said loops disposed in superposed contiguous planes at an angle of about 90 degrees relative to both said end portions, said wire being sufficiently stiff to maintain the shape of the loops and of the angle of 90 degrees upon tension on said one of said end portions of the wire.

2. A hanger for holding a suspended ceiling comprising a continuous wire having two end portions and forming two superposed, parallel and contiguous loops for holding a screw adapted to be fixed under a horizontal support, said loops substantially having the shape of a circle adjacent one of said end portions of said wire, the other of said end portions of said wire extending substantially at an angle 90 degrees relative to said loops and adapted to retain suspended ceiling, said one of said end portion extending from the lower one of said loops inside an angle of 90 degrees formed by the loops and said other of said end portion of the wire, and adapted to be tightened inside the apex of said angle upon traction on said other of said end portions, said wire being sufficiently stiff to maintain the shape of the loops and of said angle of 90 degrees upon said traction.

3. As in claim 1 or 2 wherein said wire is characterized by a stiffness sufficient to maintain its shape under normal traction by and lateral motion of the suspended ceiling.

4. As in claim 1 or 2 wherein the wire is made of soft galvanized steel wire having a diameter of 0.1 inch and a resistance to traction between 50 and 100 KIPS/P.S.I.

* * * * *